US005218737A

United States Patent [19]

Dansby et al.

[11] Patent Number: 5,218,737

[45] Date of Patent: Jun. 15, 1993

[54] DETACHABLE HOPPER AND VACUUM APPARATUS

[76] Inventors: Homer L. Dansby, 2120 Woodbrook St., Denton, Tex. 76205; William E. Green, 311 East & West St., Minden, La. 71055; Gary F. Floyd, Rt. 2 Box 111, Minden, La. 71055

[21] Appl. No.: 746,616

[22] Filed: Aug. 19, 1991

[51] Int. Cl.[5] ..... A47L 5/00

[52] U.S. Cl. ..... 15/347; 15/340.1; 15/352; 15/354; 280/491.1; 280/510; 280/638; 280/656; 280/789

[58] Field of Search ..... 15/347, 340.1, 352, 15/354; 280/491.1, 510, 514, 638, 656, 789

[56] References Cited

U.S. PATENT DOCUMENTS

| | | | |
|---|---|---|---|
| 2,361,909 | 11/1944 | Bernal | 15/352 X |
| 2,896,969 | 7/1959 | Carty | 280/491.2 |
| 3,203,022 | 8/1965 | Clarke | 15/347 X |
| 3,294,420 | 12/1966 | Martin | 280/460.1 X |
| 3,511,176 | 5/1970 | Szaj et al. | 280/510 |
| 3,572,764 | 5/1971 | Rubin | 280/491.2 |
| 3,722,025 | 3/1973 | Gledhill | 15/340.1 X |
| 4,160,302 | 7/1979 | Hirst et al. | 15/347 |
| 4,269,428 | 5/1981 | Rexine | 280/491.1 |
| 4,373,227 | 2/1983 | Kimzey et al. | 15/347 |
| 4,484,759 | 11/1984 | Zwick | 280/460.1 |

FOREIGN PATENT DOCUMENTS

| | | | |
|---|---|---|---|
| 830876 | 12/1937 | France | 15/340.1 |
| 522056 | 1/1956 | Italy | 15/340.1 |
| 725989 | 11/1966 | Italy | 15/340.1 |

*Primary Examiner*—Chris K. Moore
*Attorney, Agent, or Firm*—John M. Harrison

[57] ABSTRACT

A detachable hopper and vacuum apparatus which includes a mobile, detachable hopper adapted for use with the vacuum apparatus of this invention or towed by a tractor or alternative towing vehicle or apparatus, and characterized by a sliding tongue which is extendible in one embodiment for coupling to the towing apparatus and retractable in a second embodiment for coupling to the vacuum apparatus by means of a dual-contact coupling system. The hinged panel defines the upper half of the front panel of the detachable hopper and features a window for receiving the discharge chute of the towing vehicle or vacuum apparatus. Pivoting tandem wheels are provided on the detachable hopper for easily traversing uneven terrain. The vacuum apparatus includes a frame fitted with a blower housing, an engine connected to a blower within the blower housing for sweeping grass clippings and other debris through a chute assembly provided with bellows on the bottom side thereof and wheels for guiding the bellows over uneven terrain. Caster wheels are also provided on the vacuum apparatus and are designed for 360 degree, selectively locking, pivotal operation when the vacuum apparatus is coupled to the detachable hopper by means of the dual-contact coupling mechanism. A discharge chute projects upwardly from the discharge of the blower housing and is adapted to communicate with the panel window of the front panel of the detachable hopper when the vacuum apparatus is coupled to the detachable hopper.

20 Claims, 5 Drawing Sheets

DETACHABLE HOPPER AND VACUUM APPARATUS

BACKGROUND OF THE INVENTION

1. Field of the Invention

This invention relates to outdoor vacuum systems and more particularly, to vacuum systems used to vacuum large areas having uneven terrain such as golf courses. In a preferred embodiment the detachable hopper and vacuum apparatus of this invention is characterized by a detachable hopper fitted with tandem, pivotally-mounted wheels and having a hinged front panel provided with a panel window for receiving the discharge chute of a vacuum apparatus and collecting vacuumed material collected by the vacuum apparatus. The detachable element hopper of the invention is designed for coupling with conventional tractors or other towing vehicles by operation of a slidably-mounted tongue frame having a hitch mechanism on the extending end and adapted to extend for attachment to the towing vehicle and retract for coupling to the vacuum apparatus of this invention. The detachable hopper is also fitted with a dual contact hitch receptacle mechanism for receiving a pair of corresponding spaced, bayonet-type coupling mechanisms mounted on the vacuum apparatus to releasably secure the detachable hopper and vacuum apparatus in operational mode. In another preferred embodiment the detachable hopper is characterized by a collection bin mounted on a hopper bed in tilting or dumping fashion to facilitate easy emptying of the collection bin. The vacuum apparatus element of this invention is characterized by a frame fitted with an engine connected to a blower located in a blower housing and a chute assembly communicates with the blower housing and is provided with offset bellows and wheels located at the extending ends of the bellows for following the contours of an irregular terrain and vacuuming loose material on the terrain. A discharge chute projects from the discharge end of the blower housing and is shaped to engage the panel window in the hinged front panel of the detachable hopper when the vacuum apparatus is secured to the detachable hopper in operational mode.

The proliferation of golf courses in the United States and other parts of the world has created a growing demand for high quality, litter-free, well groomed greens and fairways to entice players. Competition between golf courses, particularly in large metropolitan areas, has resulted in great effort to insure that the greens and fairways are carefully mown, manicured and cleared of all loose liter, debris and refuse during playing hours. The clearing of such a large area of refuse, debris and litter is no small task and various type of equipment have been developed to achieve this end.

Increasing emphasis has also been placed on the care and enhancement of private lawns, as well as the lawns of commercial establishments and the like and particularly on carefully mowing and manicuring the larger lawns, to achieve the best possible visual effect. The care and grooming of such lawns, and particularly estate-size lawns, has required the use of various types of tractors, carts, collection receptacles and the like, to logistically handle the litter, debris, cuttings and other refuse.

2. Description of the Prior Art

Various types of equipment have been developed and are well known in the art for grooming, manicuring and vacuuming lawns and other outdoor surfaces such as golf courses and the like. Typical of this equipment is the apparatus detailed in the following United States patents: U.S. Pat. No. 3,522,695, dated Aug. 4, 1970, to O. Musgrave, entitled "Debris Catcher"; U.S. Pat. No. 3,755,851, dated Sep. 4, 1973, to John K. Williams, entitled "Gas Cleaning Apparatus"; U.S. Pat. No. 3,824,771, dated Jul. 23, 1974, also to John K. Williams entitled "Gas and Particulate Solid Material Separating and Solid Material Discharging Apparatus"; U.S. Pat. No. 3,903,565 dated Sep. 9, 1975, to L. T. Hicks, entitled "Leaf and Grass Cart Bagger"; U.S. Pat. No. 4,062,085, dated Dec. 13, 1977, to I. J. Duncan, entitled "Suction Cleaning Apparatus"; U.S. Pat. No. 4,095,398, dated Jun. 20, 1978, to Richard F. Aumann, et al, entitled "Grass Baggger"; U.S. Pat. No. 4,426,830, dated Jan. 24, 1984, to D. Tackett, entitled "Lawn Clipping Vacuum Collector"; U.S. Pat. No. 4,433,532, dated Feb. 28, 1984, to M. L. McCunn, entitled "Lawn Mower Bagging System Including Air Assist"; U.S. Pat. No. 4,443,997, dated Apr. 24, 1984, to Bahram Namdari, entitled "Apparatus for Vacuum Collection and Compacting of Leaves and Grass Clippings"; U.S. Pat. No. 4,699,393, dated Oct. 13, 1987, to James R. Schweigert, entitled "Multi-Purpose Trailer With Universal Mounting Hitch"; U.S. Pat. No. 4,761,943, dated Aug. 9, 1988, to Richard W. Parker, et al, entitled "Mobile Vacuum System for Use With A Riding Tractor Mower; U.S. Pat. No. 4,787,197, dated Nov. 29, 1988, to James R. Schweigert, entitled "Multi-Purpose Cart and Grass Collector"., U.S. Pat. No. 4,881,362, dated Nov. 21, 1989, to Richard W. Parker, et al, entitled "Mobile Vacuum System for Use With Riding Tractor Mower"., U.S. Pat. No. 4,885,817, dated Dec. 12, 1989, to K. Tanase, entitled "Air-Dust Separation System for Pneumatic Road-Cleaning Vehicle"; U.S. Pat. No. 4,922,696, dated May 8, 1990, to Stephen R. Burns, et al, entitled "Grass Collecting/Utility Cart for Riding Lawn Mower".

It is an object of this invention to provide a new and improved detachable hopper and vacuum apparatus, which includes a detachable hopper having a slidably-mounted tongue for optionally attaching to a conventional towing vehicle or recessing to facilitate coupling to the vacuum apparatus of this invention by means of a bayonet-type coupling mechanism.

Another object of this invention is to provide a new and improved detachable hopper and vacuum apparatus for vacuuming both irregular and smooth terrain, which detachable hopper includes a bayonet coupling hitch receptacle for coupling to the bayonet coupling of the vacuum apparatus, a hinged front panel fitted with a panel window for receiving a corresponding discharge chute provided on the vacuum apparatus, and tandem, pivoting wheels for traversing irregular terrain.

Still another object of this invention to provide a new and improved detachable hopper and vacuum apparatus for vacuuming irregular terrain and collecting the vacuumed refuse, which vacuum apparatus includes a frame, an engine mounted on the frame and coupled to a blower enclosed in a blower housing, which blower housing communicates with a chute assembly provided with flexible bellows at the bottom thereof and wheels at the extending ends of the bellows, for following the contours of the irregular terrain and vacuuming refuse and litter on the terrain in an efficient manner, which litter and refuse is transferred by the blower through the discharge chute into the detachable hopper.

Yet another object of this invention is to provide a detachable hopper for receiving refuse and litter, including grass clippings and other particulate matter, which detachable hopper is fitted with a slidably-mounted tongue for attachment to a towing vehicle when extended, the detachable hopper also having a hinged front panel fitted with a window for receiving the discharge chute of the towing vehicle and tandem, pivotally-mounted wheels for optimum traversal of irregular terrain.

Still another object of this invention is to provide a vacuum apparatus for vacuuming both flat and irregular terrain and delivering the refuse and litter vacuumed from the terrain either to a collection vehicle or to the atmosphere, which vacuum apparatus includes a frame having a blower driven by an engine and a blower housing communicating with a chute assembly provided with bellows projecting toward the ground and a set of wheels provided at the end of the bellows for traversing the ground and maintaining the mouth of the bellows in close proximity to the terrain, wherein grass clippings, litter, refuse and the like may be vacuumed from the terrain forced through the blower housing and expelled from the discharge chute.

SUMMARY OF THE INVENTION

These and other objects of the invention are provided in new and improved detachable hopper and vacuum apparatus towed by a tractor or other vehicle and characterized in a first preferred embodiment by a tiltable detachable hopper element coupled by means of a dual bayonet-type receiver mechanism to a vacuum apparatus, such that grass clippings, refuse and litter vacuumed by the vacuum apparatus is delivered to the detachable hopper for containment. In a preferred embodiment the detachable hopper is characterized by a hopper bed fitted with tandem, pivotally-mounted wheels and a collection bin mounted on the hopper bed in tilting relationship, with a hinged front panel fitted with a panel window for receiving the discharge chute of the vacuum apparatus and transferring the grass clippings, litter and refuse from the vacuum apparatus to the collection bin. In another preferred embodiment the vacuum apparatus is characterized by a frame fitted with an engine coupled to a blower mounted in a blower housing which is positioned in communication with a chute assembly having a collapsible bellows system mounted on the bottom thereof, for facing the terrain and provided with wheels for traversing the terrain and insuring that the mouth of the bellows remain in close proximity to the terrain. Grass clippings, trash and refuse traversed by the bellows are pulled through the chute assembly by operation of the blower to the discharge chute and are delivered from the discharge chute into the panel window of the hinged panel of the detachable hopper.

BRIEF DESCRIPTION OF THE DRAWINGS

The invention will be better understood by reference to the accompanying drawings, wherein.

DESCRIPTION OF THE PREFERRED EMBODIMENTS

Figure 1:
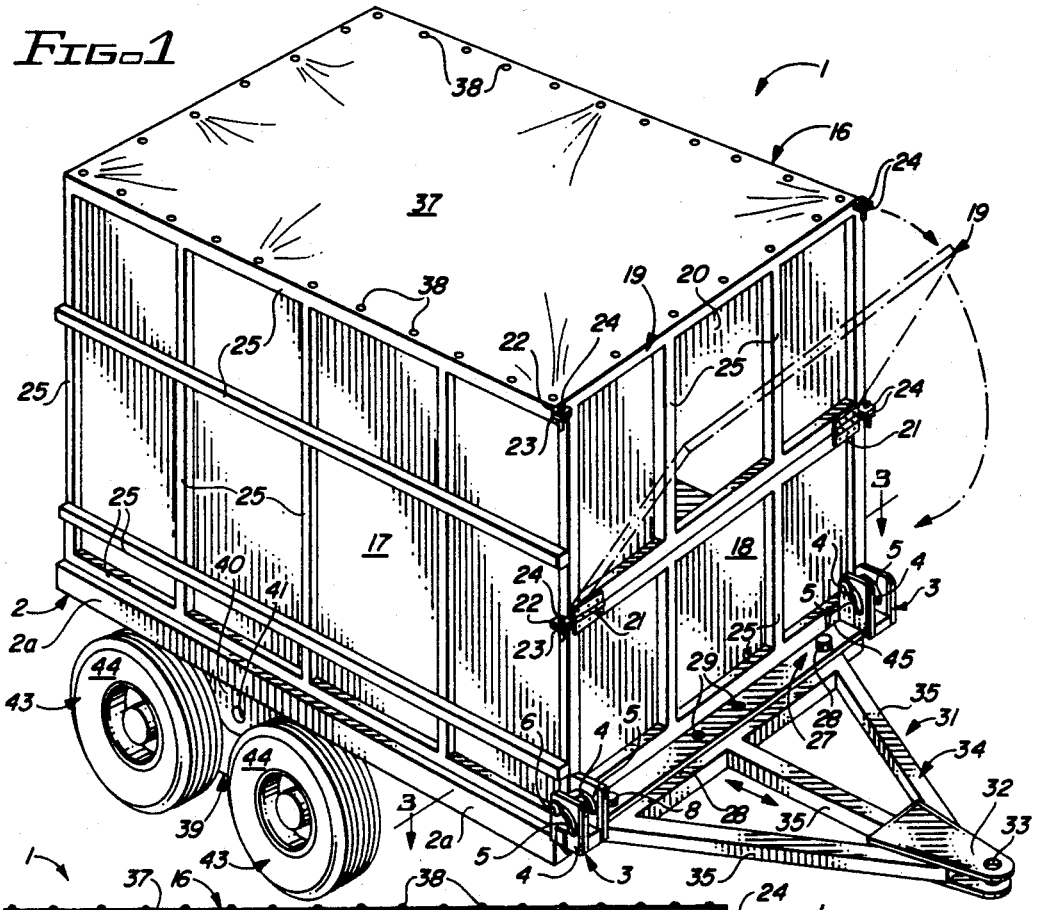
FIG. 1 is a perspective view of a preferred embodiment of the detachable hopper element of the detachable hopper and vacuum apparatus of this invention.

Referring initially to FIGS. 1–8 of the drawings, in a preferred embodiment the detachable hopper of this invention is generally illustrated by reference numeral 1. The detachable hopper 1 is characterized by a hopper bed 2, consisting of a bed frame **2*a* and bed braces 2*b*. A pair of hitch receptacles 3 are welded or otherwise attached to the front corners of the hopper bed 2 and each of the hitch receptacles 3 is characterized by a pair of coupling plates 4, having outwardly turned plate lips 8 and spaced by a guide mount plate 10 on the bottom thereof. Curved coupling pin slots 5 are provided in the coupling plates 4 in spaced, parallel relationship and a coupling pin 6 extends transversely through each of the parallel coupling pin slots 5 and is fitted with a washer 7 and a corresponding nut 7*a*. Accordingly, it will be appreciated from a consideration of the shape of the curved coupling pin slots 5 and the positioning of the coupling pin 6 in each set of coupling pin slots 5, that each coupling pin 6 may be easily manipulated from the top to the bottom of the coupling pin slots 5, as desired, as hereinafter further described. A bayonet guide 9 is welded or otherwise secured to the guide mount plate 10 and extends downwardly in angular relationship from the guide mount plate 10, as further illustrated in FIGS. 5 and 6, for purposes which will be hereinafter further described. As further illustrated in FIGS. 1–4 of the drawings, a collection bin 16 is pivotally attached to the hopper bed 2 by means of collection bin hinges 26, more particularly illustrated in FIG. 4. A pair of lift cylinders 11 are attached to the hopper bed 2 in spaced, pivoting relationship and the cylinder piston 12 of each of the lift cylinders 11 is attached to a corresponding piston bracket 13, welded to the bottom panel stiffener 25 of the collection bin 16, as further illustrated in FIG. 4. Accordingly, operation of the lift cylinders 11 by air or hydraulic means well known to those skilled in the art (not illustrated), pivots the collection bin 16 upwardly with respect to the hopper bed 2 on the collection bin hinges 26, as further illustrated in FIG. 4, to facilitate emptying of the collection bin 16. The collection bin 16 is further characterized by a pair of parallel bin side panels 17, stiffened by spaced panel stiffeners 25 and fitted with a top panel 37, secured to the top panel stiffeners 25 by top panel rivets 38 or alternative means, a rear panel (not illustrated) and a bin front panel 18, having a hinged panel 19 at the top thereof. The hinged panel 19 is further characterized by a hinged panel window 20, which is open and designed to accommodate the discharge chute of the vacuum apparatus element of this invention, as hereinafter further described. In a most preferred embodiment of the invention the hinged panel 19 is secured to the lower portion of the bin front panel 18 by means of spaced panel hinges 21 and corresponding pin brackets 22, attached to the hinge panel 19, and panel brackets 23, attached to the vertical panel stiffeners 25 and receive bracket pins 24 for securing the hinged panel 19 in upward-standing relationship against the bin side panel 17 or in downwardly-folding relationship against the bin front panels 18**, as desired.

Figure 2:
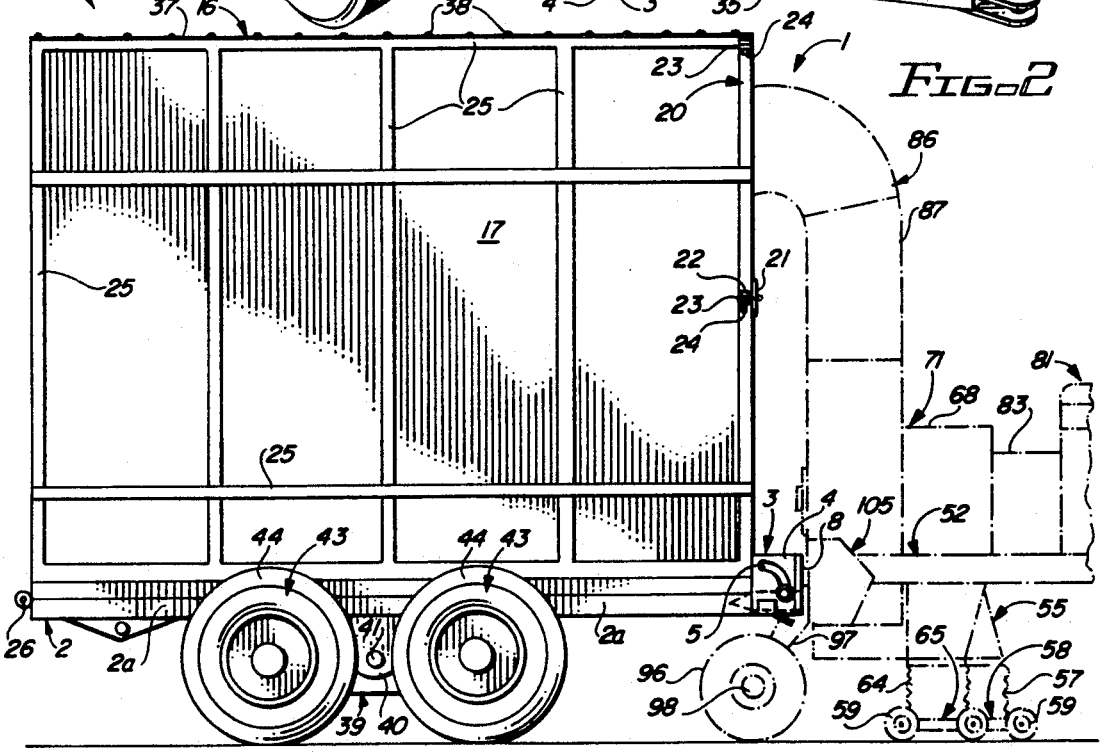
FIG. 2 is a left side elevation of the detachable hopper illustrated in FIG. 1 with the vacuum apparatus element in coupled configuration, as illustrated in phantom.
Figure 3:
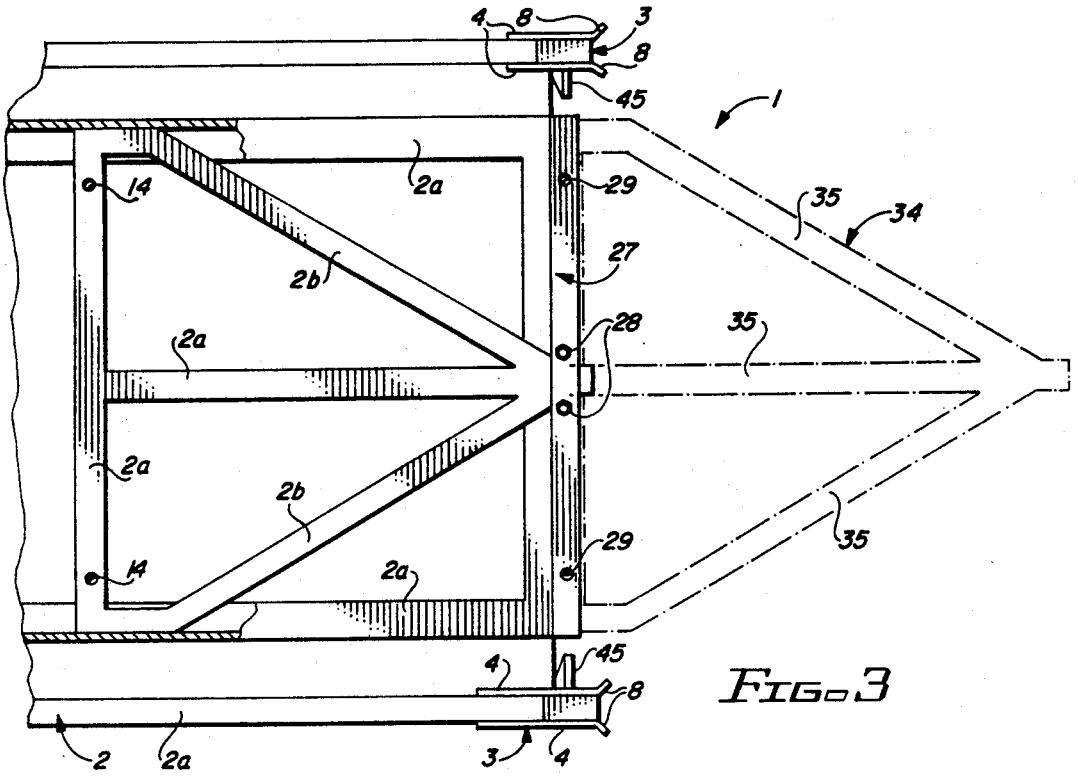
FIG. 3 is a plan view, partially in section, of the front portion of the detachable hopper illustrated in FIGS. 1 and 2.
Figure 14:
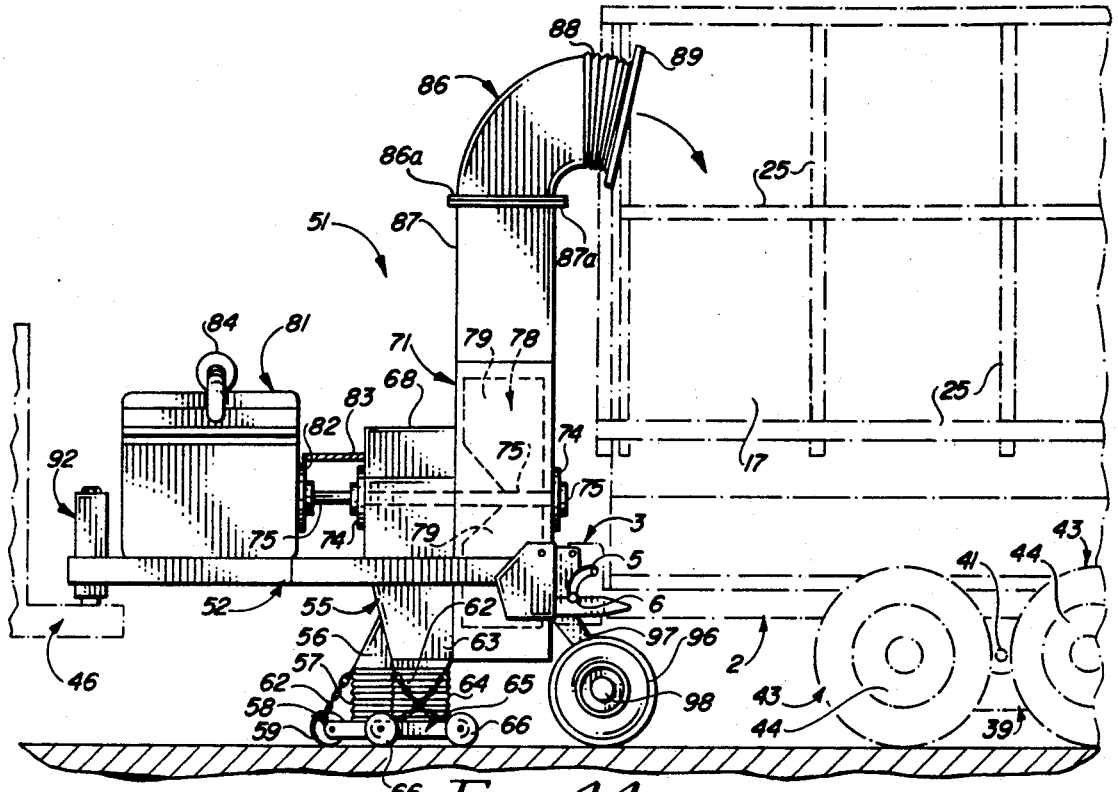
FIG. 14 is a side view of the vacuum apparatus illustrated in FIGS. 12 and 13, more particularly illustrating the detachable hopper element of the invention coupled to the vacuum apparatus, as illustrated in phantom.
Figure 15:
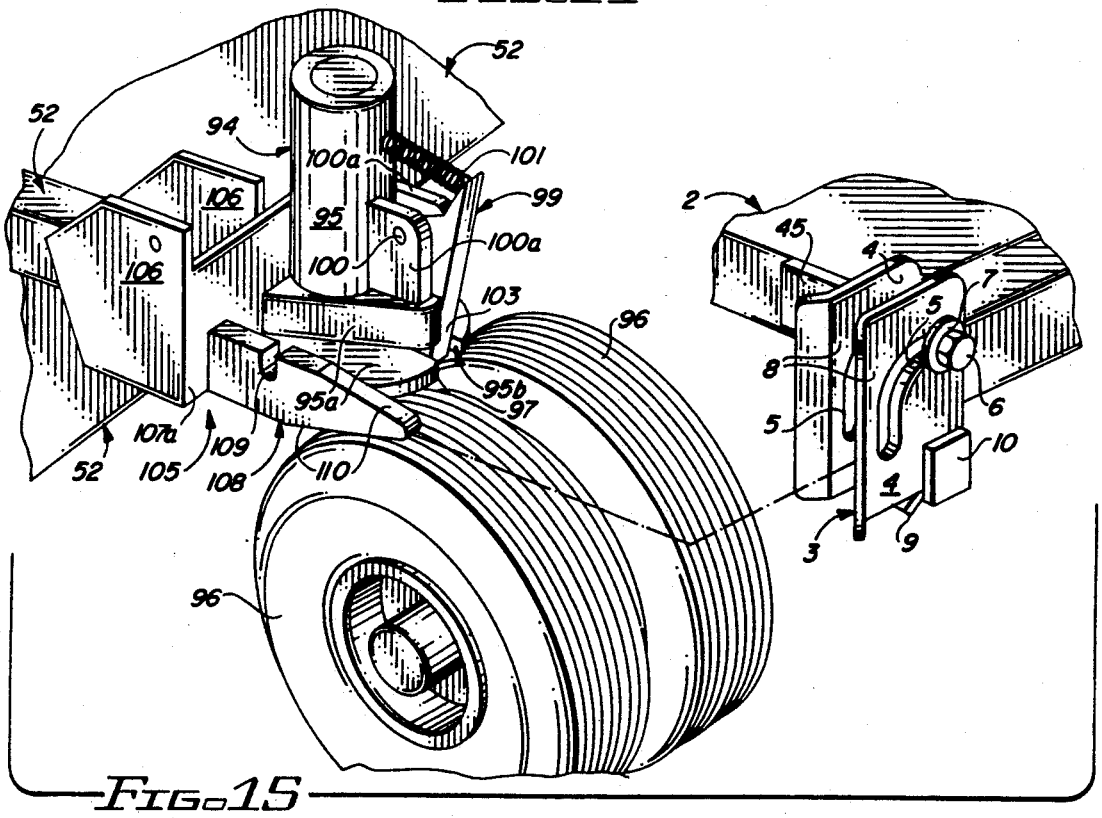
FIG. 15 is an enlarged perspective view, partially in section, of caster assembly and bayonet coupling elements of the vacuum apparatus and a corresponding plate receptacle element of the detachable hopper.

Referring now to FIG. 14 of the drawings, in a most preferred embodiment of the invention the detachable hopper 1 is designed for attachment to the vacuum apparatus 51 and the vacuum apparatus 51 to a conventional towing vehicle 46, such as a tractor or the like. Alternatively, as illustrated in FIGS. 2 and 3, the detachable hopper 1 can be connected directly to a towing vehicle by means of a sliding tongue 31, which is slidably mounted in a corresponding tongue mount frame 27, attached to the front of the hopper bed 2. The tongue mount frame 27 is fitted with tongue mount frame bolts 28, which project through aligned tongue retainer apertures 29, provided in the torque mount frame 27 and tongue frame 34, to secure the tongue 31 in extended configuration, as illustrated in FIG. 2. The tongue frame 34 is further characterized by frame members 35, fitted with a pair of ball mount plates 32, having a ball frame opening 33 for receiving a pin (not illustrated) and securing the tongue 31 to a towing vehicle (not illustrated). When it is desired to attach the detachable hopper 1 to the vacuum apparatus of this invention, the tongue mount bolts 28 are removed from the corresponding tongue retainer apertures 29 in the tongue mount frame 27 and the tongue frame 34 and the latter is slidably extended inside the hopper bed 2 on the bed frame **2*a*, as illustrated in FIG. 3. The tongue mount bolts 28 are removed from the matching outside tongue retainer apertures 29 and replaced in the aligned inside tongue retainer apertures 29 to secure the tongue 31 in the hopper bed 2, as further illustrated in FIG. 3**.

Figure 4:
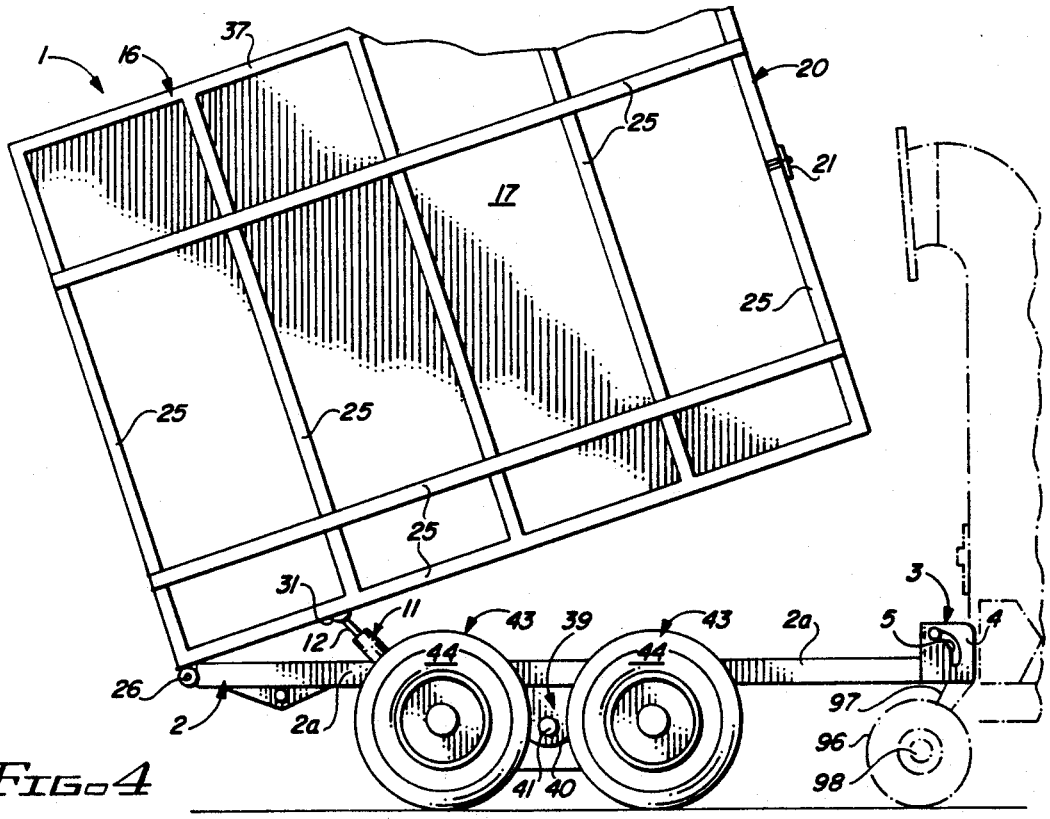
FIG. 4 is a side view, partially in section, of the detachable hopper illustrated in FIG. 2, more particularly illustrating tilting of the collection bin with respect to the hopper bed.

As illustrated in FIGS. 1, 2 and 4 of the drawings, in another most preferred embodiment of the invention the wheels 43, carrying tires 44, are attached to a common wheel trolley 39, which is pivotally attached to a trolley mount 40, welded or otherwise attached to the bed frame **2*a* of the hopper bed 2 by means of a trolley pin 41. Accordingly, the wheel trolleys 39 operate to allow the wheels 43 and tires 44 to independently pivot with respect to the hopper bed 2**, in order to more efficiently traverse irregular terrain.

Figure 12:
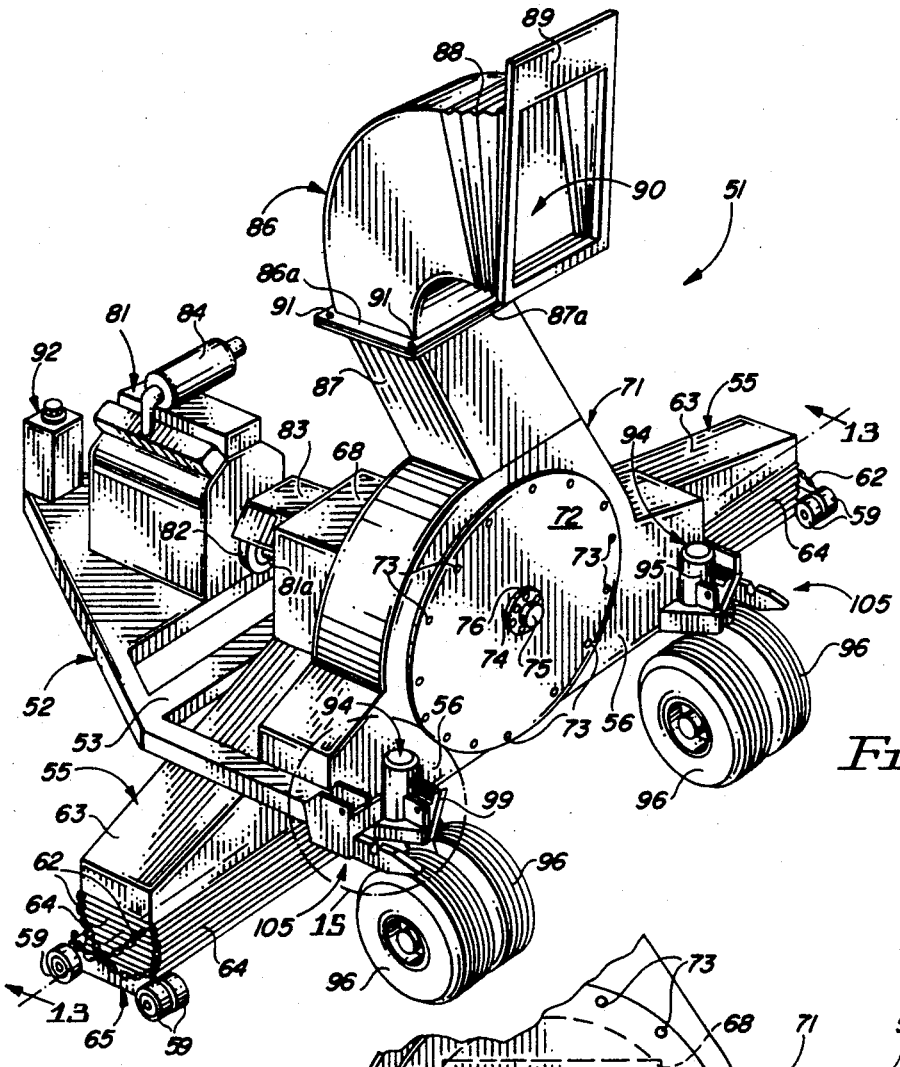
FIG. 12 is a front perspective view of a preferred embodiment of the vacuum apparatus element of the detachable hopper and vacuum apparatus of this invention.
Figure 13:
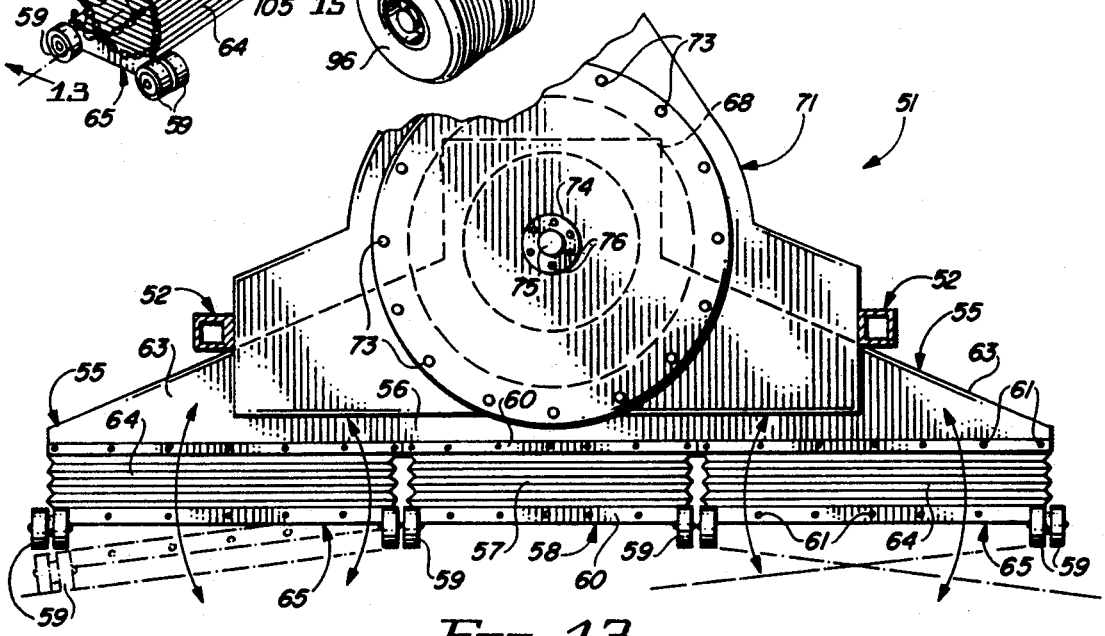
FIG. 13 is a sectional view taken along line 13—13 of the vacuum apparatus illustrated in FIG. 12.

Referring now to FIGS. 5–13 and more particularly, to FIGS. 12 and 13, in another preferred embodiment the vacuum apparatus of this invention is generally illustrated by reference numeral 51. The vacuum apparatus 51 is characterized by a vacuum apparatus frame 52, provided with a frame brace 53 and a chute assembly 55, projecting above and below the vacuum apparatus frame 52. The chute assembly 55 further includes a forward intake housing 56, fitted with a set of forward intake bellows 57, and a forward intake wheel frame 58, supporting forward intake wheels 59, as illustrated in FIG. 13. The forward intake wheel frame 58 further includes bellows mount bars 60 and corresponding mount bolts 61, for securing the forward intake bellows 57 to the forward intake wheel frame 58, such that the open end, or mouth of the forward intake bellows 57 faces downwardly, spaced from the ground level by approximately a radius of the forward intake wheels 59. Similarly, a rear intake housing 63 is provided in the chute assembly 55 and extends outwardly beyond forward intake housing 56, as further illustrated in FIGS. 13 and 14. The rear intake housing 63 is likewise fitted with rear intake bellows 64, having a rear intake wheel frame 65, supported by rear intake wheels 66. Both the forward intake bellows 57 and the rear intake bellows 64 are provided with a pair of crossed bellows chains 62, which are mounted to the forward intake housing 56 and rear intake housing 63, respectively, and the corresponding forward intake wheel frame 58 and rear intake wheel frame 65, respectively, as illustrated in FIG. 4, in order to prevent the forward intake bellows 57 and rear intake bellows 64 from hyperextending and tearing the flexible bellows. It will be appreciated from a consideration of FIG. 13 that the forward intake bellows 57 and rear intake bellows 64 are disposed in the forward intake housing 56 and rear intake housing 63, respectively, such that the mouth or open ends of the forward intake bellows 57 and rear intake bellows 64 face the ground and are separated from the ground by approximately the radius of the respective forward intake wheels 59 and rear intake wheels 66, respectively, as heretofore described. Accordingly, it will be appreciated by those skilled in the art from a consideration of FIG. 13, that the forward intake bellows 57 and rear intake bellows 64 facilitate "floating" of the forward intake wheel frame 58 and rear intake wheel frame 65 to follow the contours of the terrain traversed by the detachable hopper and vacuum apparatus and permit vacuuming of the terrain, however irregular, with optimum efficiency.

A blower housing 71 is also mounted on the vacuum apparatus frame in the forward intake housing 56, forward of the chute assembly 55, and includes a round access plate 72, secured in place by access plate bolts 73, with one end of a blower shaft 75 projecting through a blower bearing 74, located in the center of the access plate 72 and secured in place by bearing bolts 76. The blower shaft 75 extends through the blower housing 71 and the collection plenum 68 and beneath the shaft guard 83, for coupling to the engine shaft 81*a*, projecting through a shaft bearing 82 of the engine 81, also mounted on the vacuum apparatus frame 52 and fitted with a muffler 84. As further illustrated in FIG. 14, a blower 78 is mounted on the blower shaft 75 and includes blower blades 79, projecting outwardly toward the outer periphery of the blower housing 71, for creating a vacuum inside the blower housing 71 and pulling grass clippings, trash, refuse, debris and like material (not illustrated) upwardly through the forward intake bellows 57 and rear intake bellows 64 of the chute assembly 55, into the collection plenum 68 and upwardly into a chute extension 87 element of the discharge chute 86, extending from the discharge of the blower housing 71. The discharge chute 86 is further characterized by flexible chute bellows 88 and an adaptor plate 89, attached to the chute bellows 88 and having a plate opening 90, for extending through the hinge panel window 20 of the hinge panel 19 when the vacuum apparatus 51 is attached to the detachable hopper in operational mode, as hereinafter further described. In another preferred embodiment of the invention, the top portion of the discharge chute 86 is fitted with a chute plate 86*a*, the chute extension 87 is provided with a cooperating extension plate 87*a* which matches the chute plate 86*a*, and the top portion of the discharge chute 86 is attached to the chute extension 87 by means of bolts 91, as illustrated in FIG. 12. Accordingly, it will be appreciated from a consideration of FIG. 12 that the top portion of the discharge chute 86 may be positioned in selected 90 degree rotational configurations with respect to the configuration illustrated in FIG. 12, by removing the bolts 91, rotating the top portion of the discharge chute 86, including the chute bellows 88 and adaptor plate 89, to the desired 90 degree, 180 degree or 360 degree position and reinserting the bolts 91 in matching apertures in the chute plate 86*a* and extension plate 87*a*. This design facilitates discharge of material such as trash, debris, grass clippings and the like, either forwardly, rearwardly or to either side of the vacuum apparatus 51, as desired. Referring again to FIGS. 12 and 14 of the drawings, a conventional towing vehicle hitch 92 is provided on the vacuum apparatus frame 52 to facilitate towing of the vacuum apparatus 51 by a tractor or other towing vehicle 46, as desired.

Figure 10:
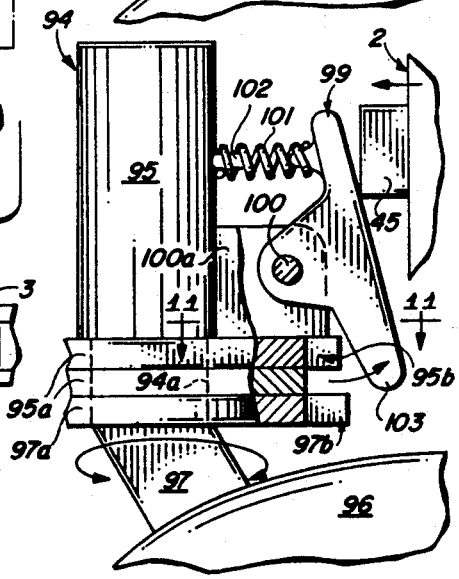
FIG. 10 is a side view, partially in section, of the caster assembly illustrated in FIG. 9, with the caster wheels in released, pivoting and operational configuration.
Figure 11:
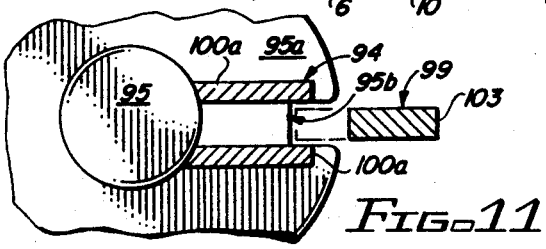
FIG. 11 is a sectional view taken along line 11—11 of the caster assembly illustrated in FIG. 10.

Referring again to FIGS. 9–15 of the drawings, in another most preferred embodiment of the invention, a pair of caster assemblies 94 are provided in spaced relationship on the vacuum apparatus frame 52, immediately above the caster wheels 96. The caster wheels 96 are each provided with a wheel bracket 97 which is shaped at the upper end to define a caster spindle 94*a*, that projects upwardly in the caster wheel hub 95 in rotatable relationship. The wheel bracket 97 is fitted with a bracket plate 97*a*, having a bracket plate slot 97*b* which matches a corresponding hub plate 95*a*, mounted on the caster wheel hub 95 and provided with a hub plate slot 95*b*. Accordingly, it will be appreciated that the caster wheels 96 will each rotate with respect to the corresponding caster wheel hub 95, while the bracket plate 97*a* and bracket plate slot 97*b* also rotate with respect to the corresponding hub plate 95*a* and hub plate slot 95*b*. A wheel lock 99 is shaped in a "T" configuration and is pivotally mounted on a pair of parallel pin mount plates 100*a*, secured to the caster wheel hub 95 and the hub plate 95*a*, as further illustrated in FIGS. 9 and 10. A spring peg 102 projects from each caster wheel hub 95 and receives one end of a wheel lock spring 101, the opposite end of the wheel lock spring 101 being secured to the upper leg of the pivotable wheel lock 99. An engaging leg 103 projects downwardly from the wheel lock 99 and normally seats in the aligned hub plate slot 95*b* of the hub plate 95*a* and bracket plate slot 97*b* of the bracket plate 97*a*. When the wheel lock 99 is in this locked position, the bracket plate 97*a* cannot pivot with respect to the hub plate 95*a* and the caster wheels 96 are locked in the orientation illustrated in FIGS. 9 and 12. However, when the lock release bar 45, attached to the hopper bed 2 of the detachable hopper 1, contacts the upper leg of the wheel lock 99 as illustrated in FIG. 10, the wheel lock 99 pivots on the wheel lock pivot pin 100, thus forcing the engaging leg 103 from the aligned hub plate slot 95*b* and bracket plate slot 97*b*, to allow 360 degree rotation of the caster wheels 96 with respect to the caster wheel hubs 95, respectively.

Figure 5:
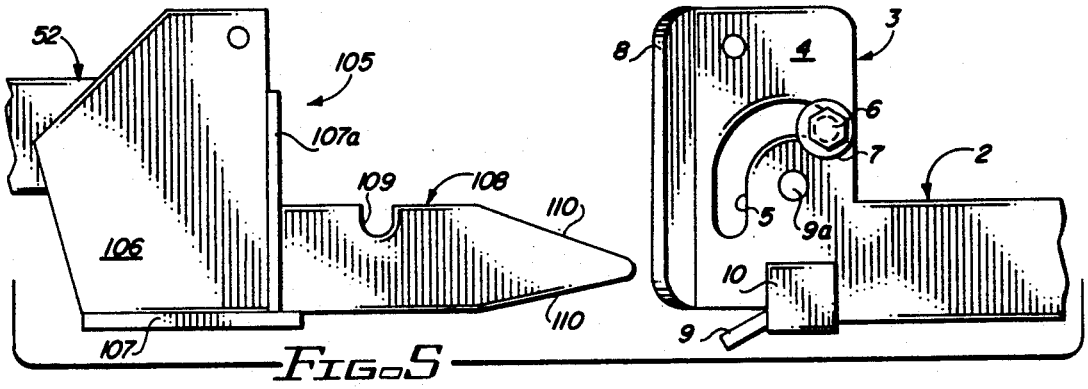
FIG. 5 is an enlarged side view, partially in section, of a typical plate receptacle attached to the detachable hopper and bayonet coupling extending from the vacuum apparatus, for releasably coupling the detachable hopper and vacuum apparatus of this invention.
Figure 6:
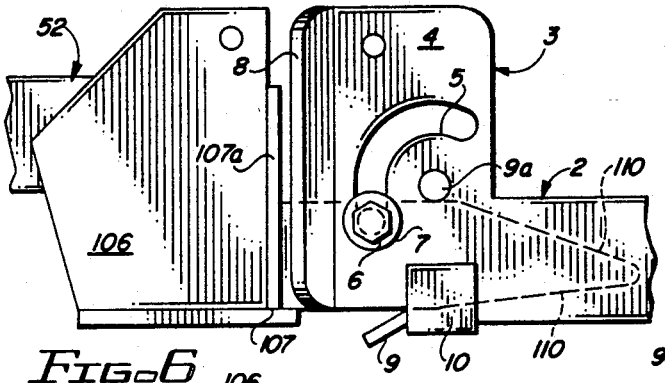
FIG. 6 is a side view, partially in section, of the plate receptacle and bayonet coupling in engaged and locked configuration wherein the detachable hopper and vacuum apparatus are coupled in operational mode.
Figure 7:
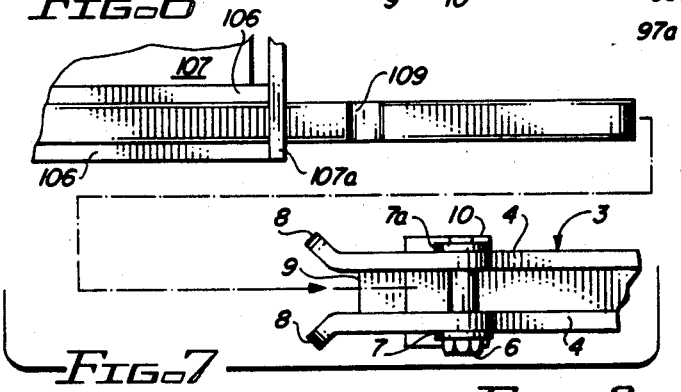
FIG. 7 is a top view of the plate receptacle and bayonet coupling illustrated in FIG. 5.
Figure 8:
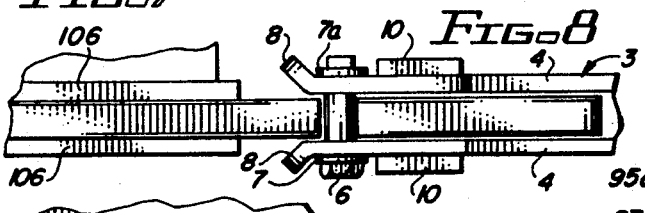
FIG. 8 is a top view of the plate receptacle and bayonet coupling illustrated in FIG. 6.
Figure 9:
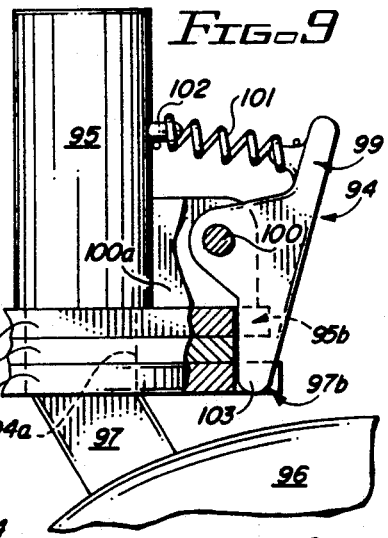
FIG. 9 is a side view, partially in section, of a typical caster assembly provided on the vacuum apparatus, with the caster assembly locked to prevent pivoting of the caster wheels.

Referring again to FIGS. 5–10 and 15 of the drawings, the detachable hopper 1 is coupled to the vacuum apparatus 51 by means of a dual set of bayonet couplings 105, each secured to a caster assembly 94 of the vacuum assembly 51 and a corresponding pair of hitch receptacles 3, provided in spaced relationship on the hopper bed 2 of the detachable hopper 1. As illustrated in FIG. 5, each bayonet coupling 105 is characterized by a pair of spaced, parallel coupling plates 106, connected by a base plate 107 and fitted with a front plate 107*a*. An elongated bayonet 108 projects forwardly from the front plate 107*a* and is fitted with a bayonet slot 109 at a point spaced from the front plate 107*a*. The projecting end of the bayonet 108 is provided with a double taper 110, as further illustrated in FIG. 5. The bayonet 108 is designed for alignment with and insertion between the parallel coupling plates 4 of the hitch receptacles 3, respectively, when the detachable hopper 1 and the vacuum apparatus 51 are oriented for coupling. Accordingly, the towing vehicle 46 is attached to the vacuum apparatus 51 by means of the towing vehicle hitch 92, as illustrated in FIG. 14 and the vacuum apparatus 51 is either backed toward the detachable hopper 1 or the detachable hopper 1 is pulled toward the vacuum apparatus 51, to engage each of the projecting bayonets 108 with the corresponding, aligned hitch receptacles 3. The bayonet taper 110 in each of the bayonets 108 then contacts the downwardly-extending bayonet guide 9 in the respective hitch receptacles 3 and causes each of the bayonets 108 to slide cleanly into the corresponding hitch receptacle 3. Linear extension of the bayonets 108 continues until the respective bayonet slots 109 in the top edges of the bayonets 108 are aligned with the bottom of the corresponding coupling pin slots 5, at which time the respective coupling pins 6 are slidably displaced from the top of the companion coupling pin slots 5, downwardly to the bottom of the coupling pin slots 5, which now correspond with the bayonet slots 109, respectively. This action locks each of the bayonets 108 in the corresponding hitch receptacles 103 and removably secures the detachable hopper 1 to the vacuum apparatus 51, as illustrated in FIGS. 6, 8 and 14.

It will be appreciated from a consideration of the drawings that the detachable hopper and vacuum apparatus of this invention may be towed by substantially any vehicle, including a tractor, truck or other vehicle, by simply connecting this vehicle represented by reference numeral 46 in FIG. 14, to the towing vehicle hitch 92 of the vacuum apparatus 51. Furthermore, it will be also appreciated that the detachable hopper 1 and vacuum apparatus 51 are both designed for traversing irregular terrain, such as the terrain found on golf courses, and maintaining the forward intake bellows 57 and rear intake bellows 64 of the chute assembly 55 in close proximity to the ground for effective vacuuming of the terrain. Moreover, other implements, such as thatching devices and the like, can be coupled to the vacuum apparatus 51 in conjunction with the detachable hopper 1, for treating the golf course or other turf, as desired.

It will be further appreciated by those skilled in the art that the rear panel (not illustrated) of the detachable hopper 1 may be designed to dump the hopper contents in any desired manner. Accordingly, the rear panel may be pivotally mounted or otherwise attached to the collection bin 16 of the detachable hopper 1, according to the knowledge of those skilled in the art.

While the vacuum apparatus 51 is illustrated and described in terms of operation by the engine 81, it will be recognized that the vacuum apparatus 51 can be driven by alternative power sources such as a power take off system from a vehicle such as a tractor, in non-exclusive particular.

It will be recognized by those skilled in the art that a primary advantage of the detachable hopper and vacuum apparatus of this invention is modularity and flexibility, in that both the detachable hopper and vacuum apparatus may be coupled to vehicles and implements of various design to suit the purpose of the users. This allows use of multiple hoppers to speed up the task when extended distances to an appropriate dump site is encountered and use of the detachable hopper 1 for a variety of purposes. Accordingly, while the preferred embodiments of the invention have been described above, it will be recognized and understood that various modifications may be made in the invention and in the use of the inventive elements and the appended claims are intended to cover all such modifications which may fall within the spirit and scope of the invention.

Having described my invention with the particularity set forth above, what is claimed is:

1. A detachable hopper adapted for selective connection to a first vehicle and a second vehicle and receiving trash and the like, said detachable hopper comprising a hopper bed; wheel means rotatably mounted on said hopper bed; collection bin means for receiving trash provided on said hopper bed; hitch receptacle means for connecting the first vehicle and the hopper provided on one end of said hopper bed; and a tongue frame retractably disposed in one end of said hopper bed for retraction in said hopper bed when said detachable hopper is connected to the first vehicle and extension from said hopper bed and connection to the second vehicle.

2. The detachable hopper of claim 1 wherein the first vehicle further comprises a vacuum apparatus and coupling means carried by said vacuum apparatus for engaging said hitch receptacle means carried by said hopper bed and removably coupling said detachable hopper to said vacuum apparatus.

3. The detachable hopper of claim 1 further comprising wheel trolley means pivotally carried by said hopper bed to allow pivoting of said wheel trolley means with respect to said hopper means and wherein said wheel means further comprises a pair of wheel carried by each of said wheel trolley means in spaced relationship.

4. The detachable hopper of claim 1 wherein the first vehicle further comprises a vacuum apparatus and coupling means carried by said vacuum apparatus for engaging said hitch receptacle means carried by said hopper bed and removably coupling said detachable hopper to said vacuum apparatus and further comprising wheel trolley means pivotally carried by said hopper bed to allow pivoting of said wheeled trolley means with respect to said hopper bed and wherein said wheel means further comprises a pair of wheels carried by each of said wheel trolley means in spaced relationship.

5. The detachable hopper of claim 1 further comprising an opening provided in said collection bin means for receiving the trash.

6. The detachable hopper of claim 5 wherein the first vehicle further comprises a vacuum apparatus having a discharge conduit adapted for extending into said opening, blower means communicating with said discharge conduit for delivering trash to said discharge conduit and coupling means carried by said vacuum apparatus for engaging said hitch receptacle means carried by said hopper bed and removably coupling said detachable hopper to said vacuum apparatus and further comprising wheel trolley means pivotally carried by said hopper bed to allow pivoting of said wheel trolley means with respect to said hopper bed and wherein said wheel means further comprise a pair of wheel carried by each of said wheel trolley means.

7. The detachable hopper of claim 1 further comprising hinge means connected to said hopper bed and said collection bin means to allow tilting of said collection bin means with respect to said hopper bed and fluid cylinder means connecting said hopper bed and said collection bin means for causing said tilting of said collection bin means with respect to said hopper bed on said hinge means.

8. The detachable hopper of claim 7 wherein the first vehicle further comprises a vacuum apparatus and coupling means carried by said vacuum apparatus for engaging said hitch receptacle means carried by said hopper bed and removably coupling said detachable hopper to said vacuum apparatus.

9. The detachable hopper of claim 7 further comprising wheel trolley means pivotally carried by said hopper bed to allow pivoting of said wheel trolley means with respect to said hopper bed and wherein said wheel means further comprise a pair of wheels carried by each of said wheel trolley means in spaced relationship.

10. The detachable hopper of claim 7 wherein the first vehicle further comprises a vacuum apparatus having coupling means carried by said vacuum apparatus for engaging said hitch receptacle means carried by said hopper bed and removably coupling said detachable hopper to said vacuum apparatus and further comprising wheel trolley means pivotally carried by said hopper bed to allow pivoting of said wheel trolley means with respect to said hppper bed and wherein said wheel means further comprises a pair of wheels carried by each of said wheel trolley means in spaced relationship.

11. The detachable hopper of claim 7 further comprising an opening provided in said collection bin means for receiving the trash.

12. The detachable hopper of claim 11 wherein the first vehicle further comprises a vacuum apparatus having a discharge conduit adapted for extending into said opening, blower means communicating with said discharge conduit for delivering trash to said discharge conduit and coupling means carried by said vacuum apparatus for engaging said hitch receptacle means carried by said hopper bed and removably coupling said detachable hopper to said vacuum apparatus and further comprising wheel trolley means pivotally carried by said hopper bed to allow pivoting of said wheel trolley means with respect to said hopper bed and wherein said wheel means further comprise a pair of wheel carried by each of said wheel trolley means in spaced relationship.

13. A vacuum apparatus adapted for towing a first vehicle, removing trash from terrain traversed by said vacuum apparatus and selective attachment to a detachable hopper having hitch receptacle means for connecting the detachable hopper and the vacuum apparatus, said vacuum apparatus comprising a frame; hitch means carried by said frame for removably connecting said vacuum apparatus to the first vehicle; coupling means carried by said frame for engaging said hitch receptacle means and removably coupling said detachable hopper to said vacuum apparatus; primary wheel means carried by said frame for supporting said vacuum apparatus on the terrain; conduit means having an intake end attached to said frame for receiving the trash and a discharge end for expelling the trash; bellows means terminating the intake end of said conduit means adjacent to the terrain for transferring the trash to said intake end; blower means communicating with said intake end of said conduit means for delivering trash from the terrain through said bellows means to said conduit means; and secondary wheel means carried by said bellows means for traversing the terrain, whereby compression and expansion of said bellows means caused said bellows means to remain substantially uniformly spaced from the terrain responsive to traversal of the terrain by said primary wheel means and said secondary wheel means for vacuuming the trash from the terrain responsive to operation of said blower means, as said vacuum apparatus is towed by the vehicle.

14. The vacuum apparatus of claim 13 wherein said coupling means further comprises bayonet coupling adapted for removably engaging said hitch receptacle means and removably connecting said detachable hopper to said vacuum apparatus.

15. The vacuum apparatus of claim 13 wherein said conduit means further comprises a chute assembly communicating with said blower means, said chute assembly defining said intake end and said discharge end and a discharge conduit extending from said discharge end of said conduit assembly and wherein said bellows means is attached to said intake end of said conduit assembly.

16. The vacuum apparatus of claim 13 wherein said conduit means further comprises a conduit assembly communicating with said blower means, said conduit assembly defining said intake end and said discharge end and a discharge conduit extending from said discharge end of said conduit assembly for discharging the trash into said detachable hopper and wherein said bellows means is attached to said intake end of said conduit assembly and said coupling means further comprises spaced bayonet couplings adapted for removably engaging said hitch receptacle means and removably connecting said detachable hopper to said vacuum apparatus.

17. A detachable hopper and vacuum apparatus adapted for connection to a towing vehicle and vacuuming and containing trash and the like, comprising a vacuum apparatus characterized by a frame; hitch means carried by said frame for removably connecting said vacuum apparatus to the towing vehicle; coupling means carried by said frame for removably coupling said detachable hopper to said vacuum apparatus; primary wheel means carried by said frame for supporting said vacuum apparatus on the terrain; conduit means having an intake end attached to said frame for receiving the trash and a discharge end for expelling the trash; bellows means terminating the intake end of said conduit means adjacent to the terrain for transferring the trash to said intake end; a blower communicating with said intake end of said conduit means for delivering trash to said conduit means and secondary wheel means carried by said bellows means for traversing the terrain, whereby compression and expansion of said bellows means caused said bellows means to remain substantially uniformly spaced from the terrain responsive to traversal of the terrain by said primary wheel means and said secondary wheel means for vacuuming the trash from the terrain responsive to operation of said blower as said vacuum apparatus is towed by the vehicle; and a detachable hopper characterized by a hopper bed; wheel means rotatably mounted on said hopper bed; a collection bin provided on said hopper bed for receiving the trash; an opening provided in said collection bin for accommodating said discharge end of said conduit means and receiving the vacuumed trash; hitch receptacle means provided on one end of said hopper bed for selective connection to said coupling means; and a tongue frame slidably carried by one end of said hopper bed for selective retraction in said hopper bed when said detachable hopper is connected to said vacuum apparatus and extension from said hopper bed and connection to said towing vehicle.

18. The detachable hopper and vacuum apparatus of claim 17 wherein said conduit means further comprises a conduit assembly communicating with said blower means, said conduit assembly defining said intake end and said discharge end and a discharge conduit extending from said discharge end of said conduit assembly and wherein said bellows means is attached to said intake end of said conduit assembly.

19. The detachable hopper and vacuum apparatus of claim 17 wherein said coupling means further comprises bayonet couplings adapted for removably engaging said hitch receptacle means and removably connecting said detachable hopper to said vacuum apparatus.

20. The detachable hopper and vacuum apparatus of claim 17 wherein said conduit means further comprises a conduit assembly communicating with said blower means, said conduit assembly defining said intake end and said discharge end and a discharge conduit extending from said discharge end of said conduit assembly for discharging the trash into said detachable hopper and wherein said bellows means is attached to said intake end of said conduit assembly and said coupling means further comprises spaced bayonet couplings adapted for removably engaging said hitch receptacle means and removably connecting said detachable hopper to said vacuum apparatus.

* * * * *